US011594796B2

(12) United States Patent
Ayoub et al.

(10) Patent No.: US 11,594,796 B2
(45) Date of Patent: Feb. 28, 2023

(54) CROSS SLOT POLARIZER

(71) Applicant: STC.UNM, Albuquerque, NM (US)

(72) Inventors: Firas Nazem Ayoub, Albuquerque, NM (US); Christos G. Christodoulou, Albuquerque, NM (US); Emil Ardelean, Albuquerque, NM (US); Steven Lane, Albuquerque, NM (US)

(73) Assignees: UNM Rainforest Innovations, Albuquerque, NM (US); The U.S. Government as Represented by the Secretary of the Air Force, Washington, DC (US)

( * ) Notice: Subject to any disclaimer, the term of this patent is extended or adjusted under 35 U.S.C. 154(b) by 490 days.

(21) Appl. No.: 16/700,745

(22) Filed: Dec. 2, 2019

(65) Prior Publication Data

US 2020/0176841 A1 Jun. 4, 2020

Related U.S. Application Data

(60) Provisional application No. 62/774,147, filed on Nov. 30, 2018.

(51) Int. Cl.

| | |
|---|---|
| ***H01Q 13/10*** | (2006.01) |
| ***H01P 1/17*** | (2006.01) |
| ***H01Q 5/35*** | (2015.01) |

(52) U.S. Cl.
CPC ..... *H01P 1/171* (2013.01); *H01Q 5/35* (2015.01); *H01Q 13/10* (2013.01)

(58) Field of Classification Search
CPC ... H01P 1/171; H01P 1/17; H01P 5/12; H01Q 15/24; H01Q 13/10; H01Q 5/35; H01Q 13/00; H01Q 13/02; H01Q 13/0241
See application file for complete search history.

(56) References Cited

U.S. PATENT DOCUMENTS

| | | | | |
|---|---|---|---|---|
| 4,613,869 A * | 9/1986 | Ajioka | H01Q 3/443 | 343/768 |
| 5,134,420 A * | 7/1992 | Rosen | H01Q 13/04 | 343/773 |
| 5,194,876 A * | 3/1993 | Schnetzer | H01Q 13/18 | 343/769 |
| 6,028,562 A * | 2/2000 | Guler | H01Q 21/005 | 343/770 |

FOREIGN PATENT DOCUMENTS

| | | | |
|---|---|---|---|
| JP | 10878948 A * | 3/1996 | |
| JP | 2003133850 A * | 5/2003 | |

* cited by examiner

*Primary Examiner* — Tho G Phan
(74) *Attorney, Agent, or Firm* — Keith Vogt, Ltd.; Keith A. Vogt

(57) ABSTRACT

A polarizer including an antenna connected to a waveguide. The waveguide including a broad wall having a cross-slot in communication with at least one port.

10 Claims, 10 Drawing Sheets

CROSS SLOT POLARIZER

RELATED APPLICATIONS

This application claims priority to U.S. Provisional Application No. 62/774,147 filed on Nov. 30, 2018, which in incorporated herein in its entirety.

STATEMENT REGARDING FEDERALLY SPONSORED RESEARCH & DEVELOPMENT

This invention was made with government support under Contract Number FA9453-16-2-0073 awarded by the United States Air Force. The government has certain rights in the invention.

INCORPORATION BY REFERENCE OF MATERIAL SUBMITTED ON A COMPACT DISC

Not applicable.

BACKGROUND OF THE INVENTION

Circular polarization is very important for communication links due to the fact that it can increase the probability of receiving the signal by any linearly polarized receiver. In particular, circular polarization is important for satellite to earth communication because it solves the problem of misalignment between the transmitter and receiver.

In addition, circular polarization is also used in radar systems especially in environments where wave depolarization takes place. The radar system in this case can support both right-hand circularly polarized (RHCP) waves and left-hand circularly polarized (LHCP) waves.

Multiple techniques are used in order to radiate circular polarization. Certain systems use circularly polarized antennas by nature such as spiral antennas, helical antennas, circularly polarized patch arrays among others, and some other systems use high gain waveguide fed antennas that can support circular polarization and are fed by wave polarizers, orthomode transducers and, phase shifters.

Several techniques are used to design wave polarizers in circular and square waveguides. These techniques include using a metallic or dielectric septum polarizer that delays one of the electric field components of the wave in the waveguide and operates in a single band. Also, the use of corrugations and irises in the waveguides creates a single circular polarization at the output of the waveguide.

Another technique is using an orthomode transducer (OMT) that is fed by two waves that have a 90° phase shift. The output of the transducer is a circularly polarized wave and can be changed from RHCP to LHCP by changing the phase shift from +90° to −90° . An OMT can be used to receive one polarization sense while transmitting a different polarization sense simultaneously. One last technique that is similar to the OMT, is the septum OMT polarizer, where both RHCP and LHCP can be generated, and when one polarization sense is transmitted the other polarization sense can be received simultaneously.

BRIEF SUMMARY OF THE INVENTION

In one embodiment, the present invention provides a method, approach, system and, solution that provides an electromagnetic wave polarization technique that can be used at millimeter-wave frequencies. The polarization technique is based on a cross-slot on the broad wall of a rectangular waveguide. The embodiment can be used to create a single band of operation or multi-bands of operation. The polarizer is used to feed waveguide fed antennas that can support circularly polarized waves.

In one embodiment, the present invention provides a method, approach, system and solution that may be used to create two polarization senses (RHCP and LHCP) by changing the feeding port.

In one embodiment, the present invention provides a method, approach, system and solution that may be used to create a linear polarization by feeding both ports in phase.

In one embodiment, the present invention provides a method, approach, system and solution that uses cross-slots in the broad wall of a rectangular waveguide. The use of several slots can create different bands of operation that are far apart from each other. The embodiment may also be done in order to transmit in a polarization sense while receiving in another polarization sense.

In one embodiment, the present invention provides a method, approach, system and solution that provide polarizers that are easy to fabricate. Fabrication could be done using a combination of milling techniques and laser etching, or 3D printing and electroless copper plating.

In one embodiment, the present invention provides a method, approach, system and solution that may be used to feed a conical horn, a pyramidal horn, a lens antenna, a reflector antenna amongst others.

It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

In the drawings, which are not necessarily drawn to scale, like numerals may describe substantially similar components throughout the several views. Like numerals having different letter suffixes may represent different instances of substantially similar components. The drawings illustrate generally, by way of example, but not by way of limitation, a detailed description of certain embodiments discussed in the present document.

DETAILED DESCRIPTION OF THE INVENTION

Detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a representative basis for teaching one skilled in the art to variously employ the present invention in virtually any appropriately detailed method, structure or system. Further, the terms and phrases used herein are not intended to be limiting, but rather to provide an understandable description of the invention.

Figure 1:
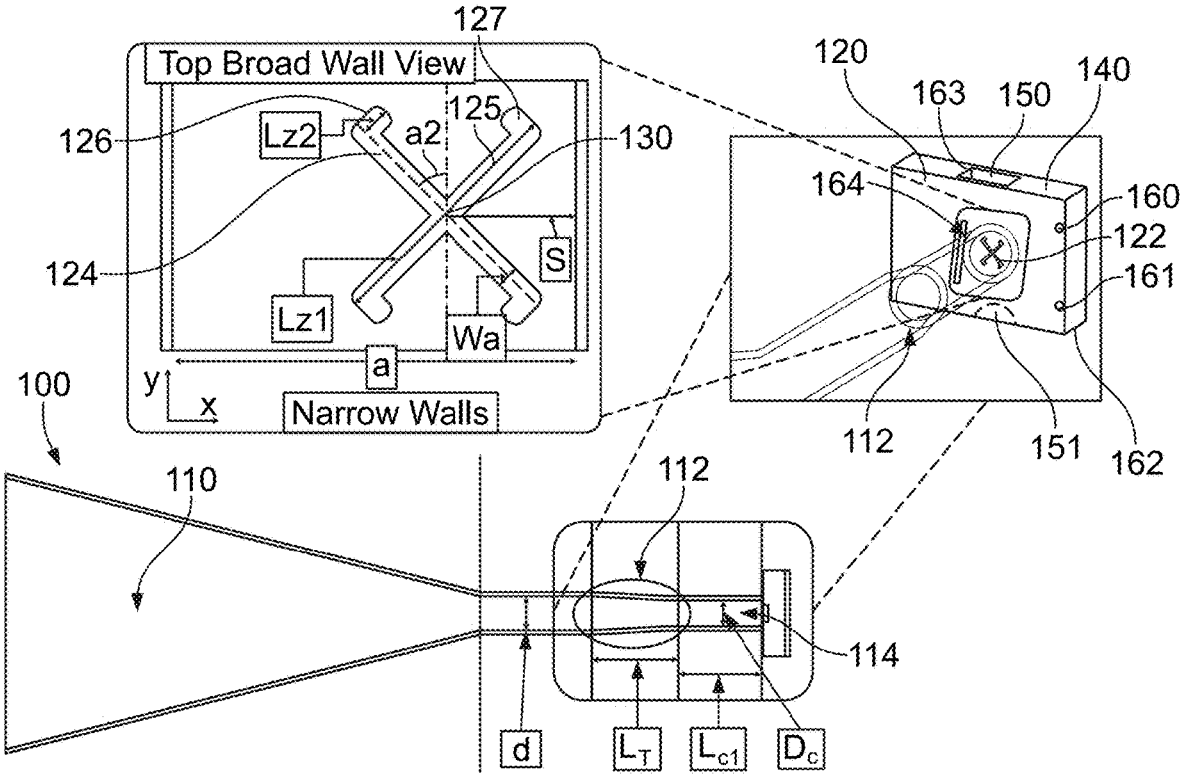
FIG. 1 illustrates an embodiment of the present invention using a single slot feeding of a conical horn antenna.

In one embodiment, the present invention provides a method, approach, system and solution that uses at least two intersecting slots or openings in a waveguide in order to extract a circularly polarized wave into either a square waveguide or a circular waveguide. In one preferred embodiment, as shown in FIG. 1, polarizer 100 includes horn antenna 110, tapered waveguide 112, and waveguide extraction section 114 which may be circular. As further shown, in the broad wall of waveguide 120, cross slot 122 is provided. Cross slot 122 may be comprised of a plurality of openings or segments 124 and 125 that may be linear in configuration or nonlinear. Openings or segments 124 and 125, in a preferred embodiment, include terminal ends 126 and 127 that produce a Z-shape. The intersecting segments create an arrangement on the broad-wall of a waveguide that may be used to extract a circularly polarized wave into either a square waveguide or a circular waveguide. Z-shape arms may be used in order to fit the arrangement on broad-wall upper edge 140 of waveguide 120.

The cross-slot total arm length is chosen to be resonant at the frequency of interest, in this case, either 72 GHz or 84 GHz. The total arm length is equal to half the guided wavelength ($\lambda_g/2$) of the desired frequency of operation. The different slot physical dimensions are shown in FIG. 1.

The point of intersection of cross-slot is situated at a position "s" 130 from the end of the broad-wall, where the components of the magnetic field, in a $TE_{10}$ mode, are equal in magnitude and 90° out of phase.

The position "s", for both a circular waveguide and a square waveguide extraction, is given by the following equation:

$$s = \frac{a}{2} \pm \frac{a}{\pi}\tan^{-1}\sqrt{\left(\frac{2fa}{c}\right)^2 - 1}$$

Where "a" is the width of the waveguide, "c" is the speed of light in vacuum, and "f" is the frequency of operation.

The rectangular waveguide has two feeding ports 150 and 151 at its ends. When the two ports are fed in phase with the same power, the resulting polarization of the polarizer is linear. When only one port is fed, a circular polarization results. In this case, when the feeding port is changed, the polarization sense changes as well from RHCP to LHCP and vice versa. The non-feeding port can be used simultaneously to receive the other polarization sense.

The cross slot may be situated at the center of the extracting waveguide and radiates the power extracted into it with circular polarization.

When the extraction waveguide is a circular waveguide as shown in FIG. 1, the diameter of the waveguide is optimized in order for the wave impedance of the waveguide to match the cross-slot impedance. The excited modes in the waveguide are $TE_{11}$ modes with 90° phase difference.

The circular waveguide is used to feed a conical horn. Tapered circular waveguide 112 is used in order to match the diameter of the extraction waveguide to the input of the conical horn as shown in FIG. 1.

Ridges may be added in the rectangular waveguide on the narrow wall of the waveguide opposing the cross slot in order to improve the isolation between the input and output ports of the rectangular waveguide. As shown in FIG. 1, a ridge 164 is located on narrow wall 163.

Figure 2:
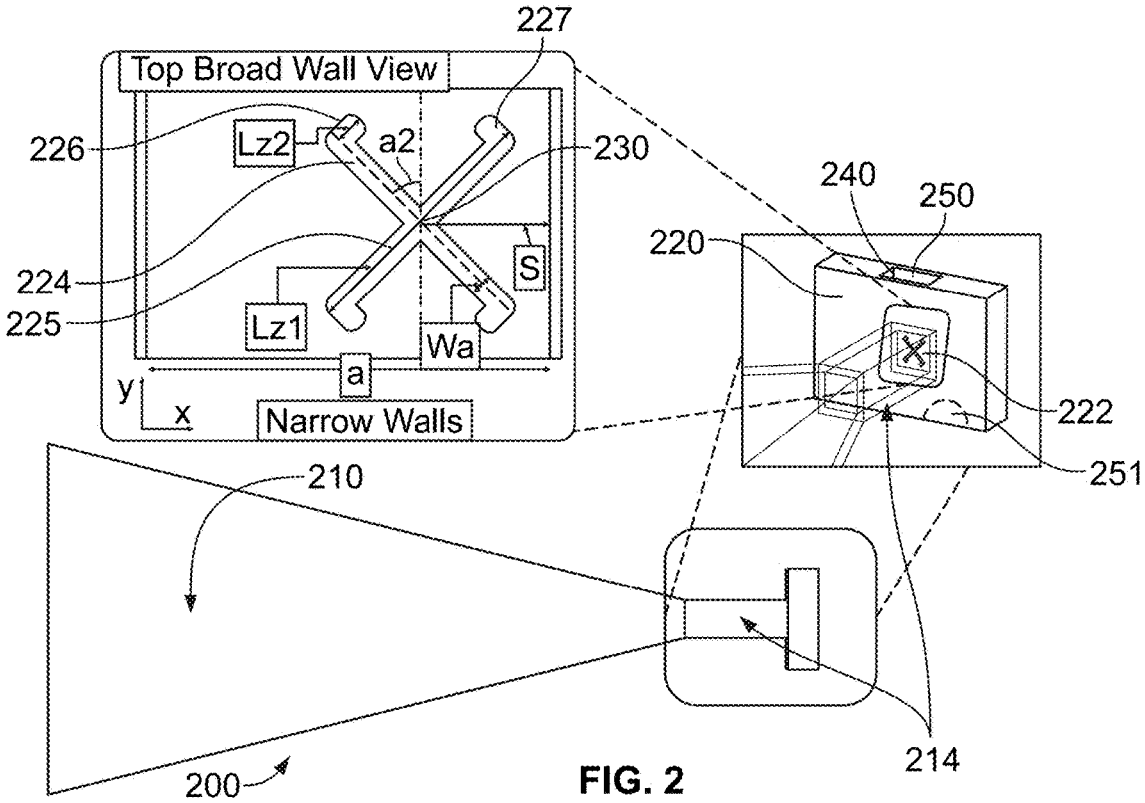
FIG. 2 illustrates an embodiment of the present invention using single slot feeding of a symmetrical pyramidal horn

In another preferred embodiment, as shown in FIG. 2, polarizer 200 includes horn antenna 210 and waveguide extraction section 214 which may be square or rectangular including ports 250 and 251. As further shown, in a broad wall 240 of waveguide 220, cross slot 222 is provided. Cross slot 222 may be comprised of a plurality of openings or segments 224 and 225 that may be linear in configuration or nonlinear. Openings or segments 224 and 225 include terminal ends 226 and 227 that create Z-shapes. The intersecting segments create an arrangement on the broad wall of the waveguide that may be used to extract a circularly polarized wave into either a square waveguide or a circular waveguide. The Z-shape arms may be used in order to fit the arrangement on broad-wall 240 of waveguide 220.

When the extraction waveguide is a square waveguide, the side dimensions of the waveguide should be optimized in order for the wave impedances for both $TE_{10}$ and $TE_{01}$ in the square waveguide to match the cross-slot impedance. The excited modes in the waveguide are $TE_{10}$ and $TE_{01}$ with 90° phase difference. The square waveguide may be used to feed a symmetrical pyramidal horn. A tapered square waveguide may be used to match the dimensions of the extraction waveguide to the input of the square waveguide.

In both extraction methods, the cross-slot can be designed in order to have a single resonance, or a very close proximity double resonance. One such example is shown in FIG. 3, where the 72 GHz model operates in double resonance mode, and the 84 GHz model operates in a single resonance mode.

Figure 3:
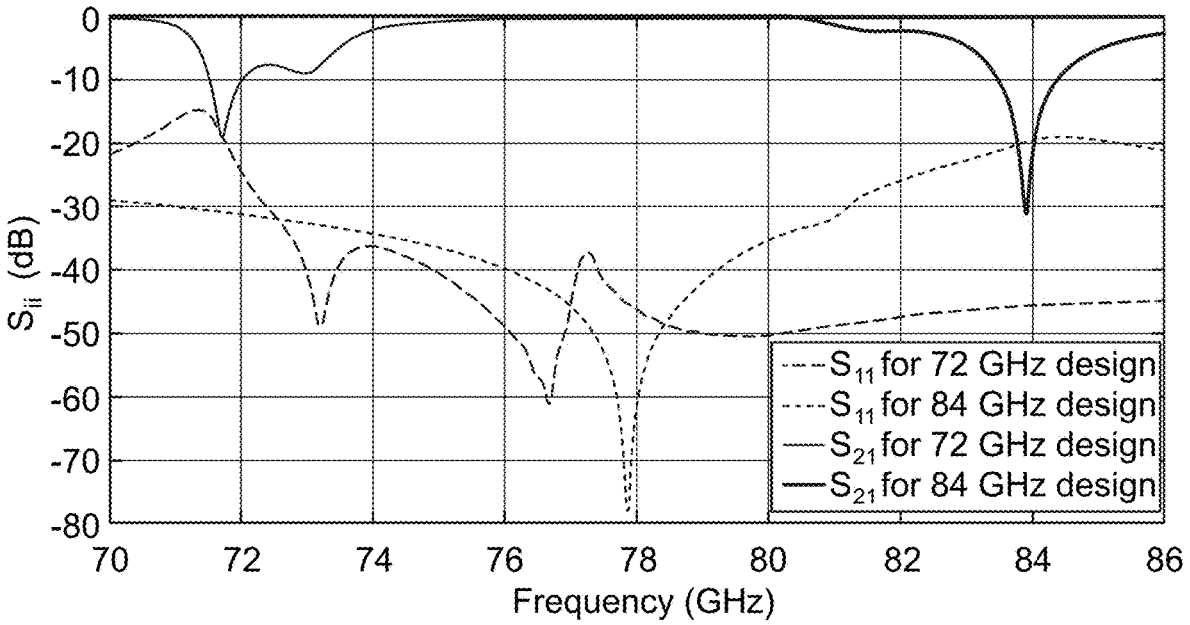
FIG. 3 shows the reflection coefficient and the isolation between both ports for both 72 and 84 GHz embodiments of the present invention.

The isolation between the two feeding ports can reach values higher than 20 dB as shown in FIG. 3, allowing the polarizer to operate in both the transmitting and receiving modes simultaneously.

Figure 4A:
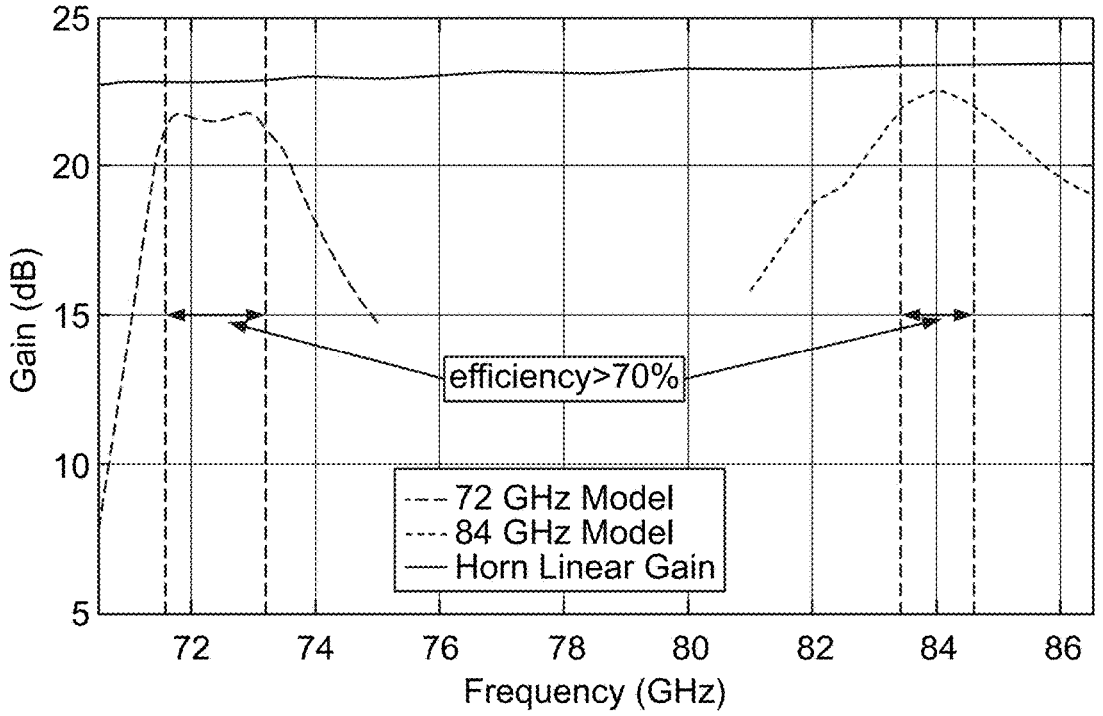
FIG. 4A illustrates the maximum gain of the 72 and 84 GHz embodiments compared to the linear gain of the horn.

The double resonance improves the 70% bandwidth of operation of the polarizer. The single resonance improves the maximum efficiency of the polarizer as shown in FIG. 4A. The polarizer operating bandwidth ranges from 1.2-1.6%.

Figure 4B:
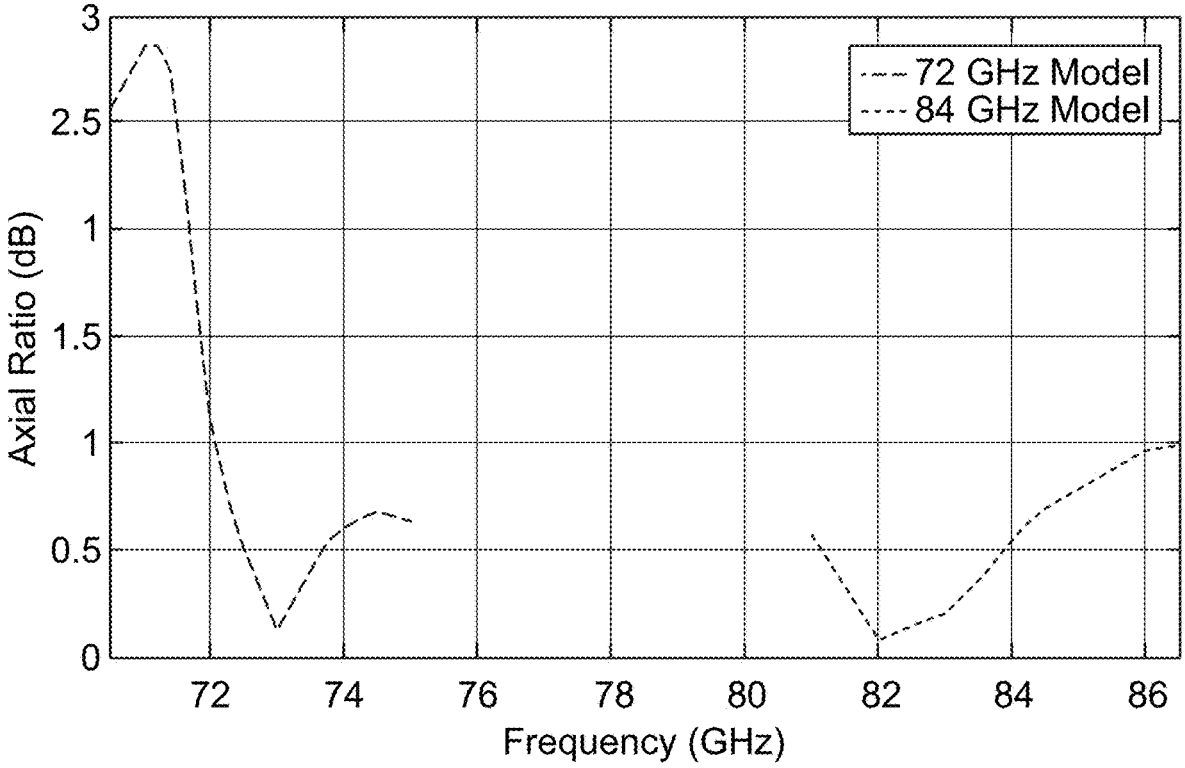
FIG. 4B illustrates the axial ratio of the 72 and 84 GHz embodiments.
Figure 5A:
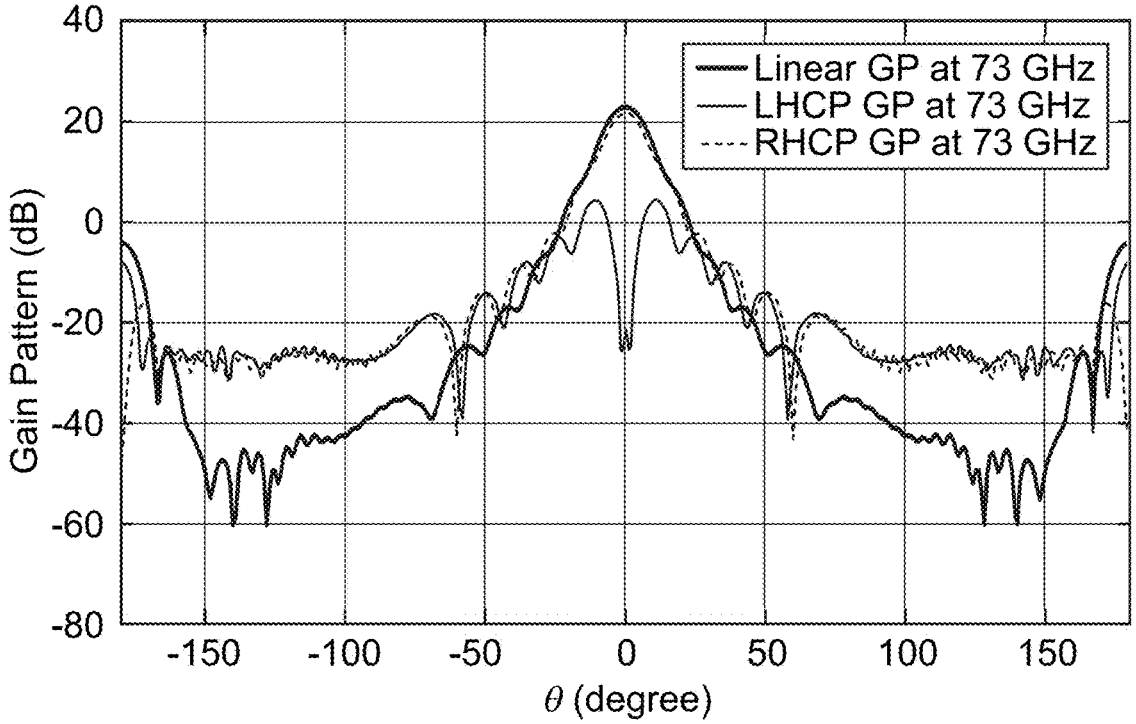
FIG. 5A illustrates a gain pattern at 73 GHz in $\phi$ equal 0 degrees.
Figure 5B:
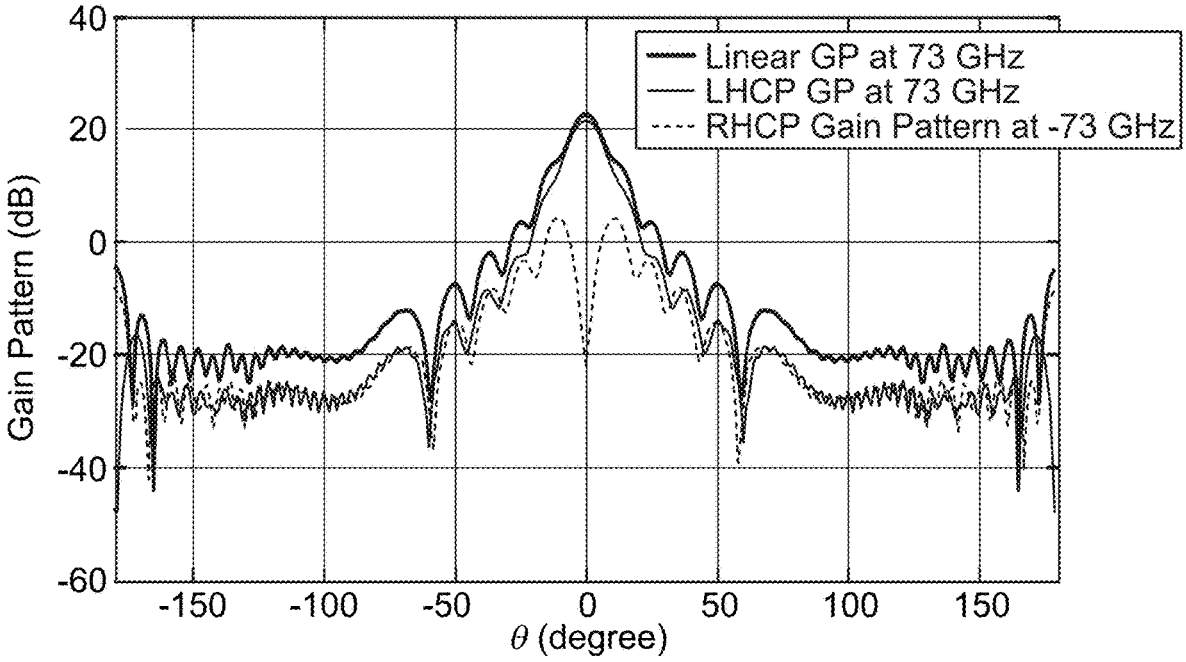
FIG. 5B illustrates a gain pattern at 73 GHz in $\phi$ equal 90 degrees.

The polarizer in all of its designs can create an axial ratio less than 1 dB for the entire band of operation as shown in FIG. 4B. Also, the HPBW of the main lobe is circularly polarized with cross-polarization discrimination higher than 18 dB as shown in FIGS. 5A and 5B.

Figure 6A:
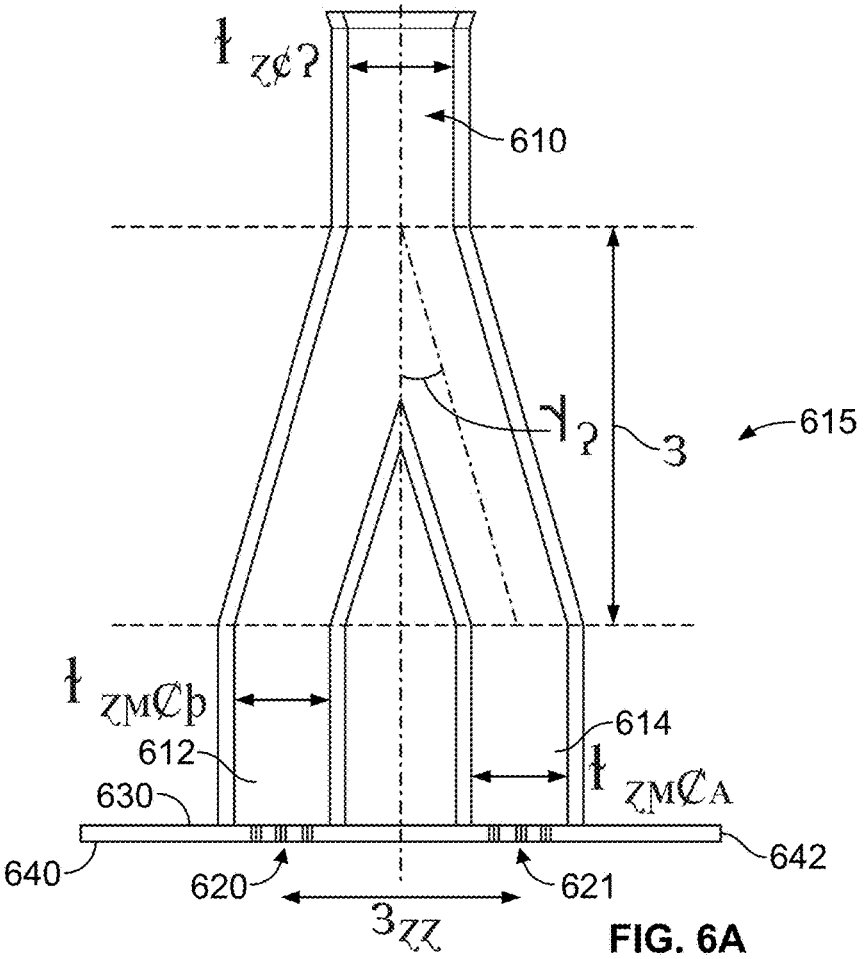
FIG. 6A illustrates a square waveguide combiner for an embodiment of the present invention.

Other designs may be used with the embodiments disclosed above. For example, to improve the bandwidth of the design, as shown in FIG. 6A, polarizer 600 may include output waveguide 610 and a plurality of input waveguides 612 and 614 that create a power combiner 615. In addition, a plurality of cross-slots 620-621 can be used in waveguide 630 which is rectangular. The plurality of cross-slots' power may be combined using square waveguides power combiners 615.

Figure 6B:
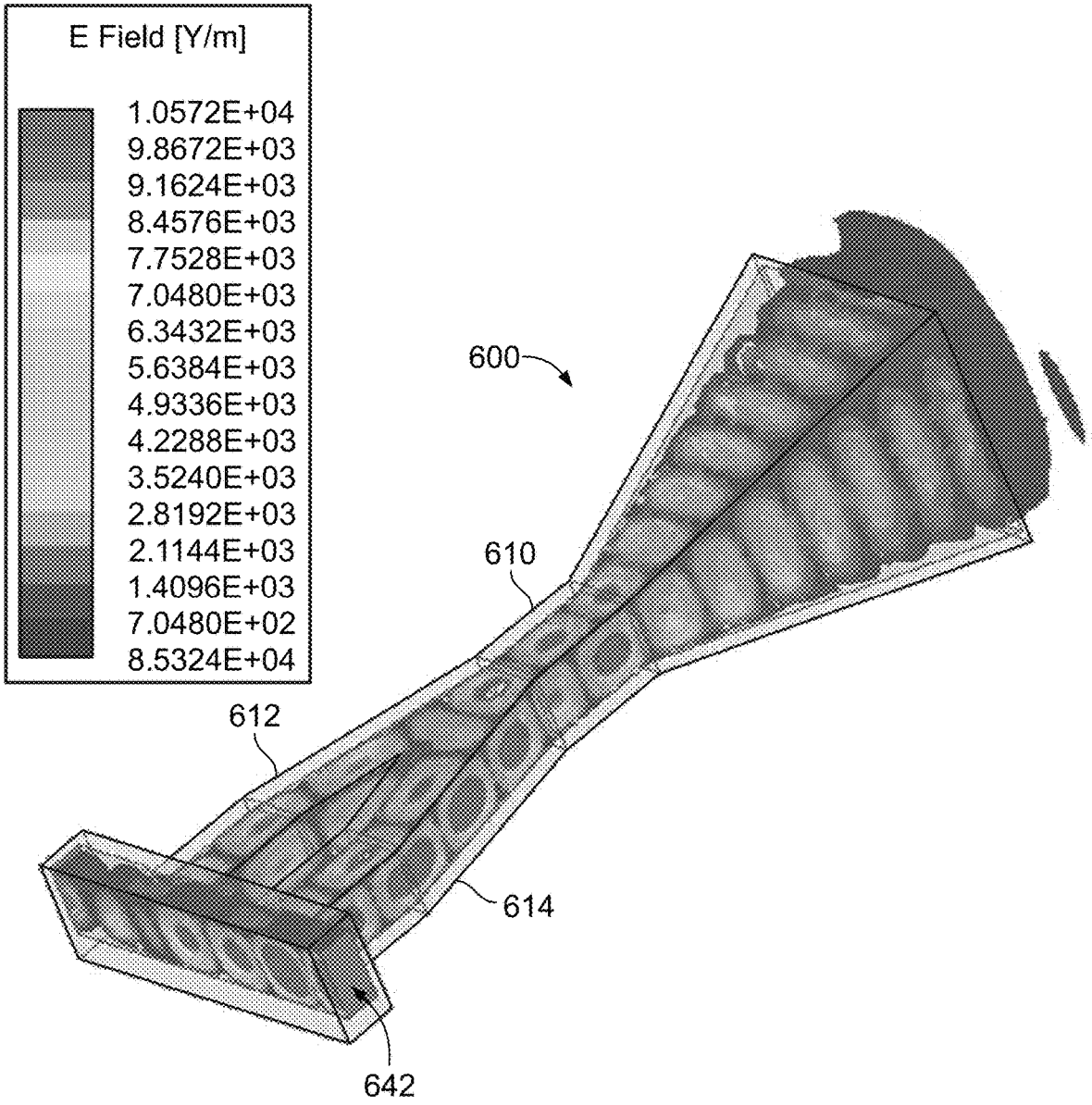
FIG. 6B illustrates the E-field inside the different sections of the full system at 72 GHz when a pyramidal horn is connected to the embodiment shown in FIG. 6A.

In a first application, two slots could be used. When the two slots have the same dimensions, more power can be extracted from the waveguide hence improving the 70% efficiency bandwidth. In addition, the two slots contribute to improving the isolation between ports 640 and 642 as shown in FIGS. 6A and 6B. The slots are connected to square waveguides that have their dimensions optimized to match the impedance of the slots. The extraction waveguides are then connected to a power combiner that will not affect the purity of the circular polarization of the wave.

In a preferred embodiment, power combiner 615 is comprised of two inputs that are tapered waveguides. These two waveguide sections connect the extraction or input waveguides to the output waveguide of the power combiner. The tapering of these two waveguide sections is done gradually in order to match the dimensions of each waveguide and maximize the power transfer.

The separation between the cross slots along with the dimensions of the output waveguide and the length of the tapered waveguides play an important role in keeping the axial ratio of the extracted circularly polarized wave intact. Also, these dimensions are carefully chosen in order to avoid having a standing wave in the output of the power combiner. FIG. 6B shows how power combiner 615 does not affect the circular polarization of the wave.

Figure 7:
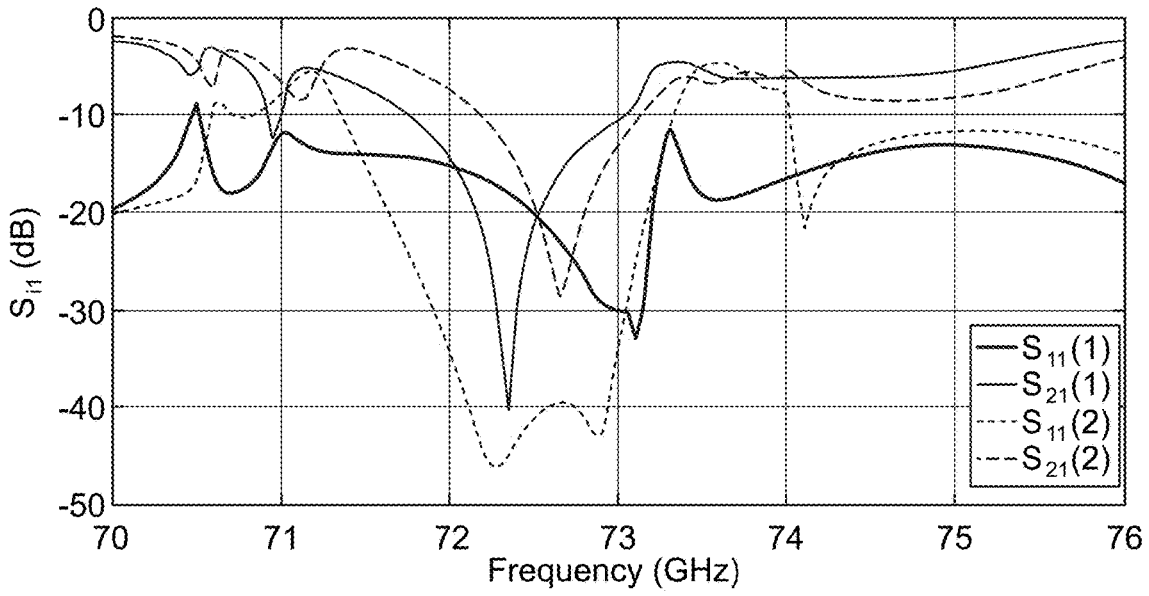
FIG. 7 illustrates S-parameters of the different embodiments of the present invention.
Figure 8A:
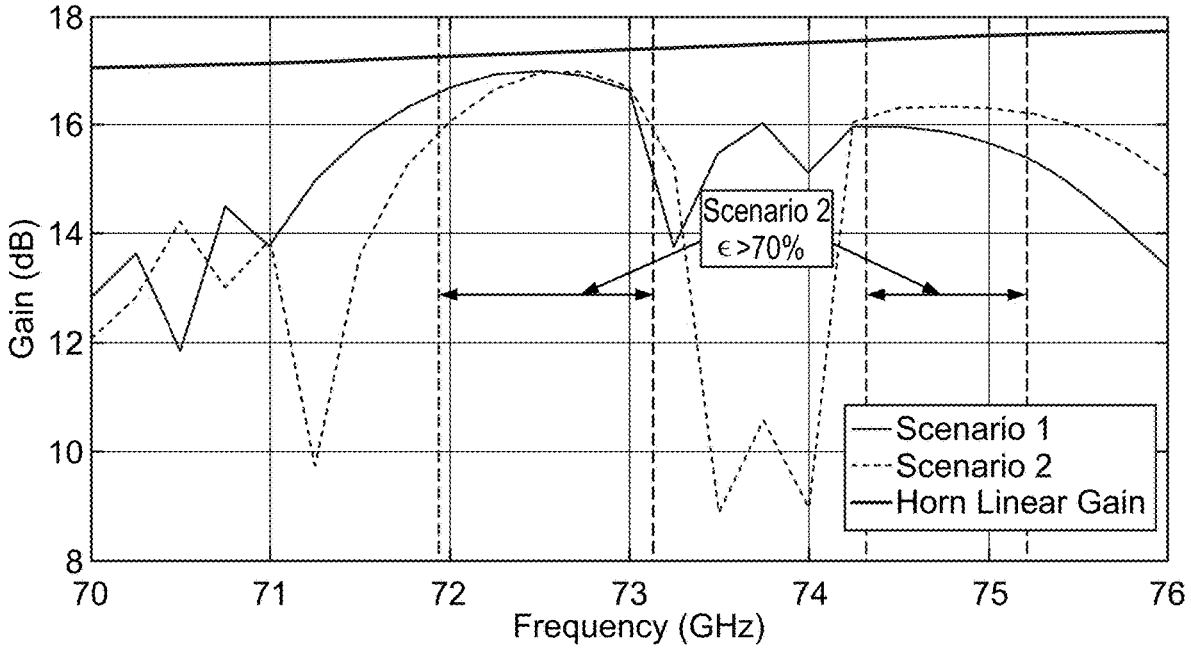
FIG. 8A is a gain comparison of two embodiments of the present invention.
Figure 8B:
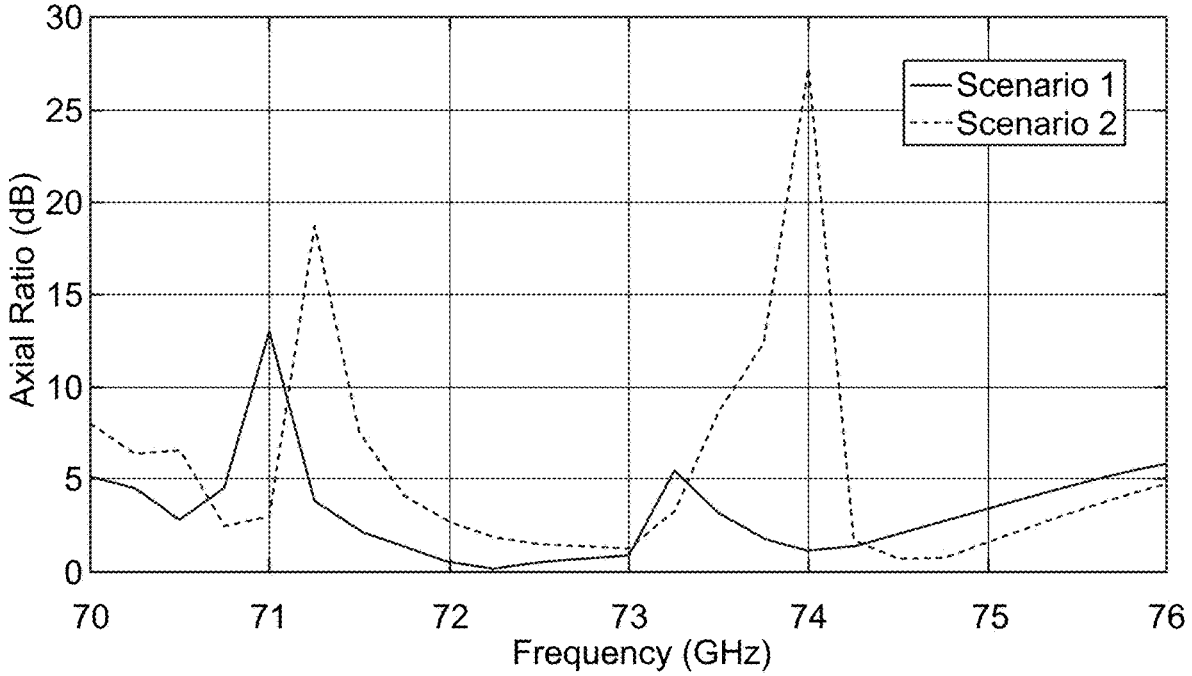
FIG. 8B is an axial ratio comparison of two embodiments of the present invention.

In another embodiment, the slots may have slightly different dimensions, causing it to naturally resonate at a slightly different frequency. This application improves the initial band of operation and adds another band that is also 1.2% of bandwidth, where the polarizer has also 70% efficiency and more. A comparison between the bandwidth performance of this embodiment with the above-disclosed embodiments is shown in FIG. 7. A comparison between the gain and circular polarization performance of the embodiments is shown in FIGS. 8A and 8B.

Figure 9A:
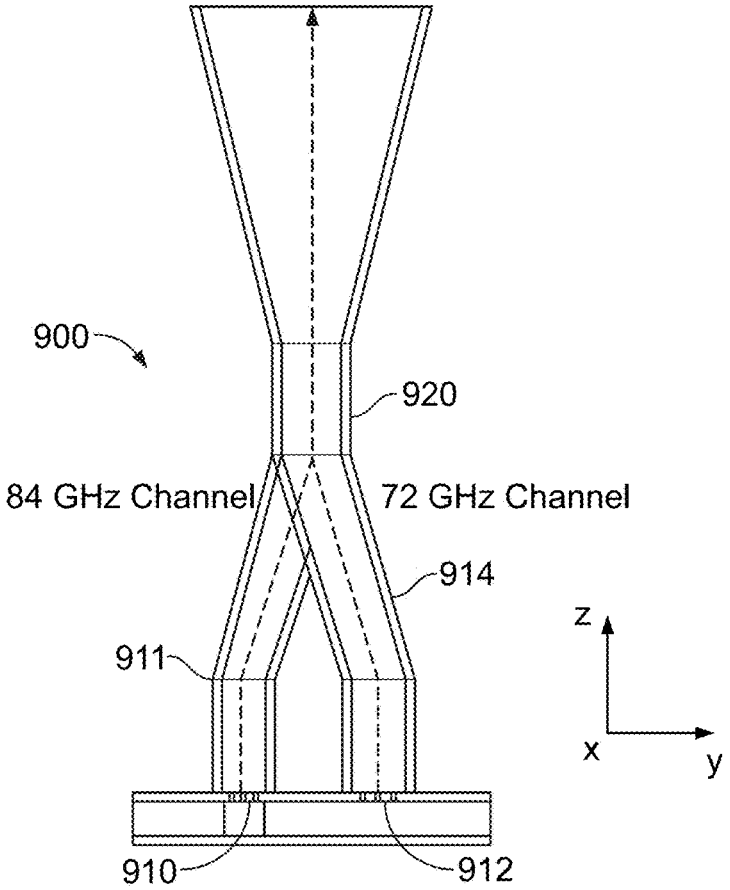
FIG. 9A depicts a polarizer having two square waveguide channels for multi-band operation for an embodiment of the present invention.
Figure 9C:
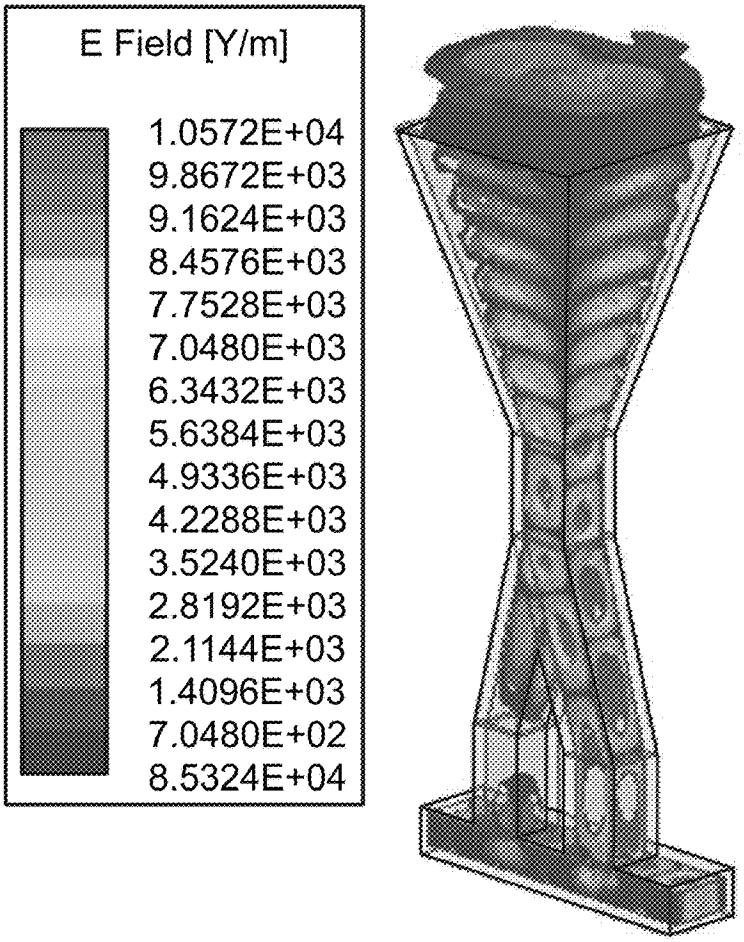
FIG. 9C illustrates the E-field in the other of the two square waveguide channels for the embodiment shown in FIG. 9A.
Figure 9B:
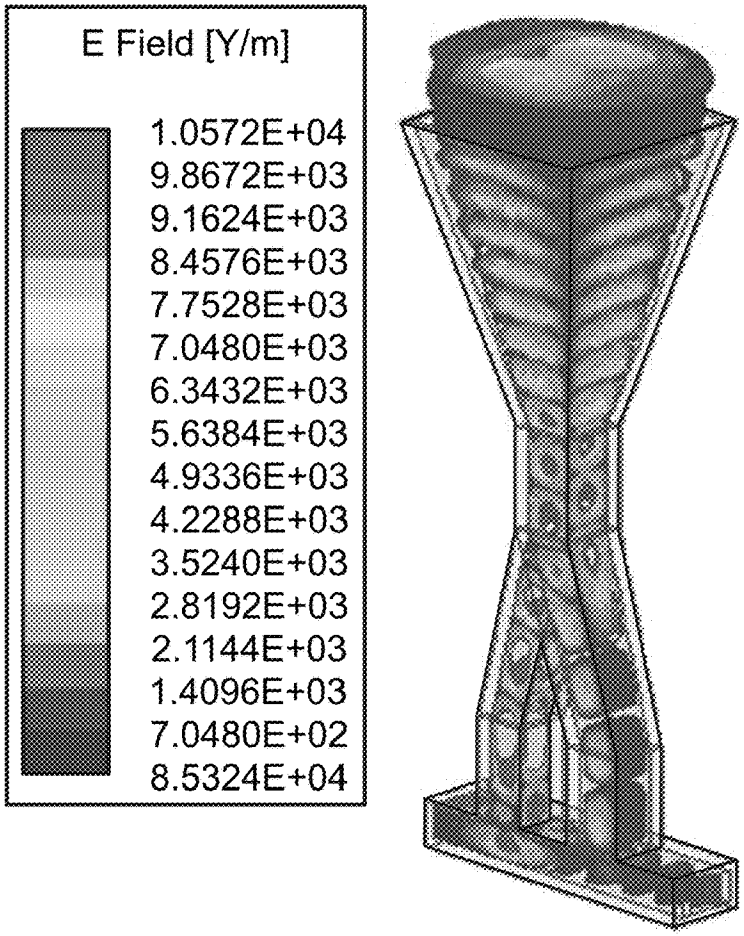
FIG. 9B illustrates the E-field in one of the two square waveguide channels for the embodiment shown in FIG. 9A.

In yet another embodiment, as shown in FIGS. 9A-9C, polarizer 900 may be configured to work at frequency bands that are far apart from each other. One such design is done at 72 and 84 GHz although other frequency bands may be used as well. In this embodiment, cross slot 910 operates at 84 GHz. This embodiment also includes extraction waveguide 911 that has a cutoff frequency for both $TE_{10}$ and $TE_{01}$ that is higher than 72 GHz. Cross slot 912 operates at 72 GHz and includes extraction waveguide 914. Each extraction waveguide creates a channel that mainly extracts the power and operates at the channel frequency: one for 72 GHz and one for 84 GHz.

The channels are combined into an output waveguide 920. In a preferred embodiment, waveguides 911 and 914 are tilted tapered square waveguides with the narrower sections being opposingly located from the point of merger with output waveguide 920 as shown in FIG. 9A.

The separation between the slots and the length of the tapered waveguide is essential in order to improve the circular polarization properties at the output of the channels combiner.

With this embodiment, the properties of the combiner are optimized in order to improve the performance at the 84 GHz frequency band. The 72 GHz channel also channels a low power at 84 GHz and hence the whole system works as a power combiner at 84 GHz.

Figure 10:
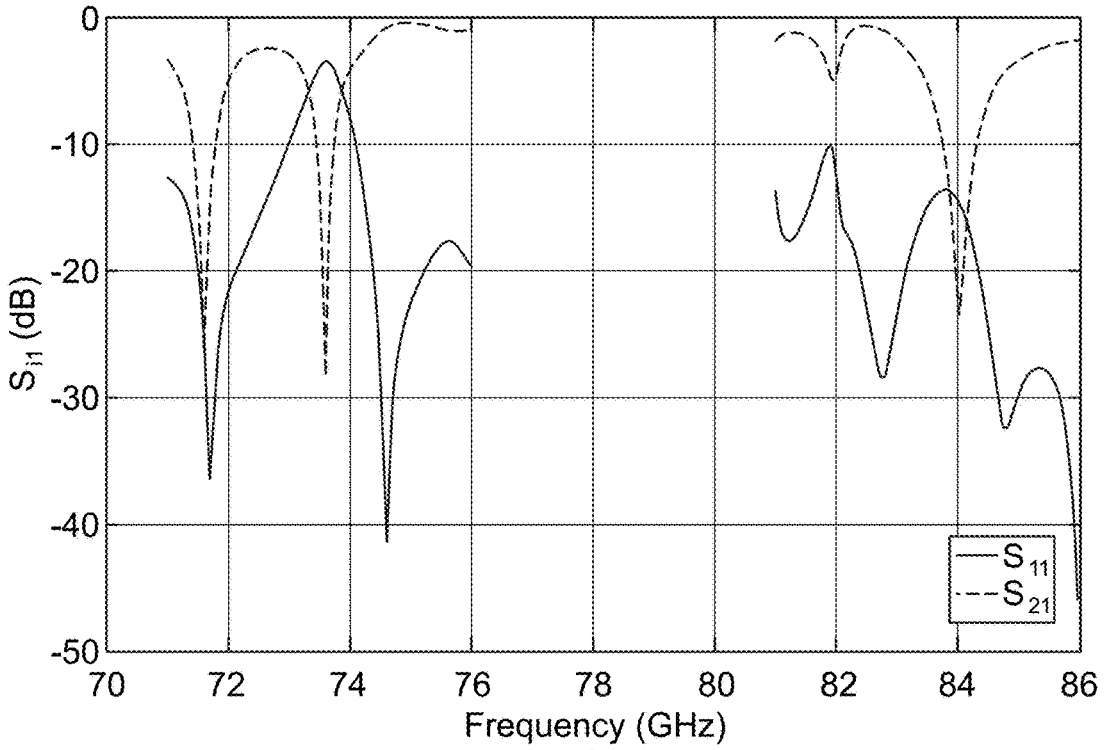
FIG. 10 illustrates S-parameters of the system with two channels for an embodiment of the present invention.
Figure 11:
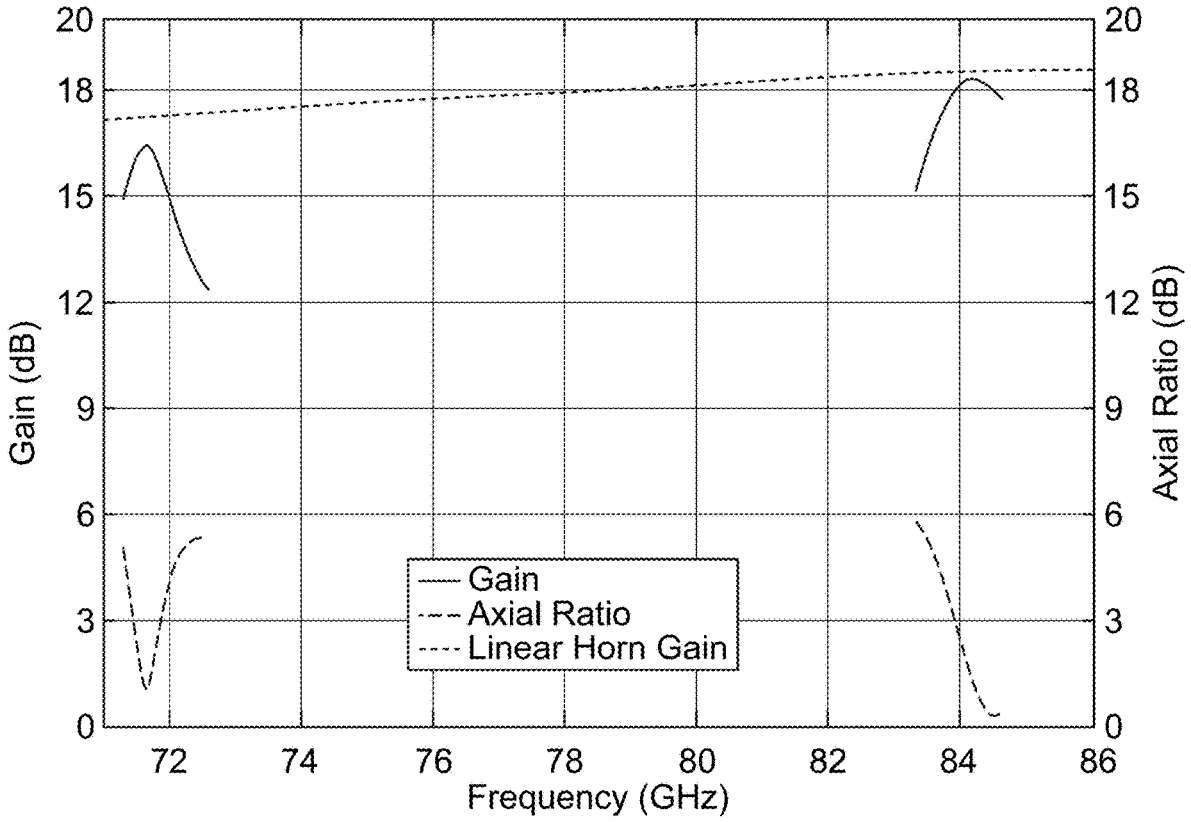
FIG. 11 illustrates the gain and axial ratio of a two-channel design for an embodiment of the present invention.

Polarizer 900 can create an isolation of more than 20 dB at both frequencies of operation as shown in FIG. 10. In addition, the bandwidth of polarizer 900 is around 1.2-1.5% for each frequency band of operation, with an efficiency higher than 70%. Also, polarizer 900 may be optimized in order to deliver an axial ratio value less than 3 dB reaching lower than 1 dB for the frequency bands of operation as shown in FIG. 11.

Figure 12:
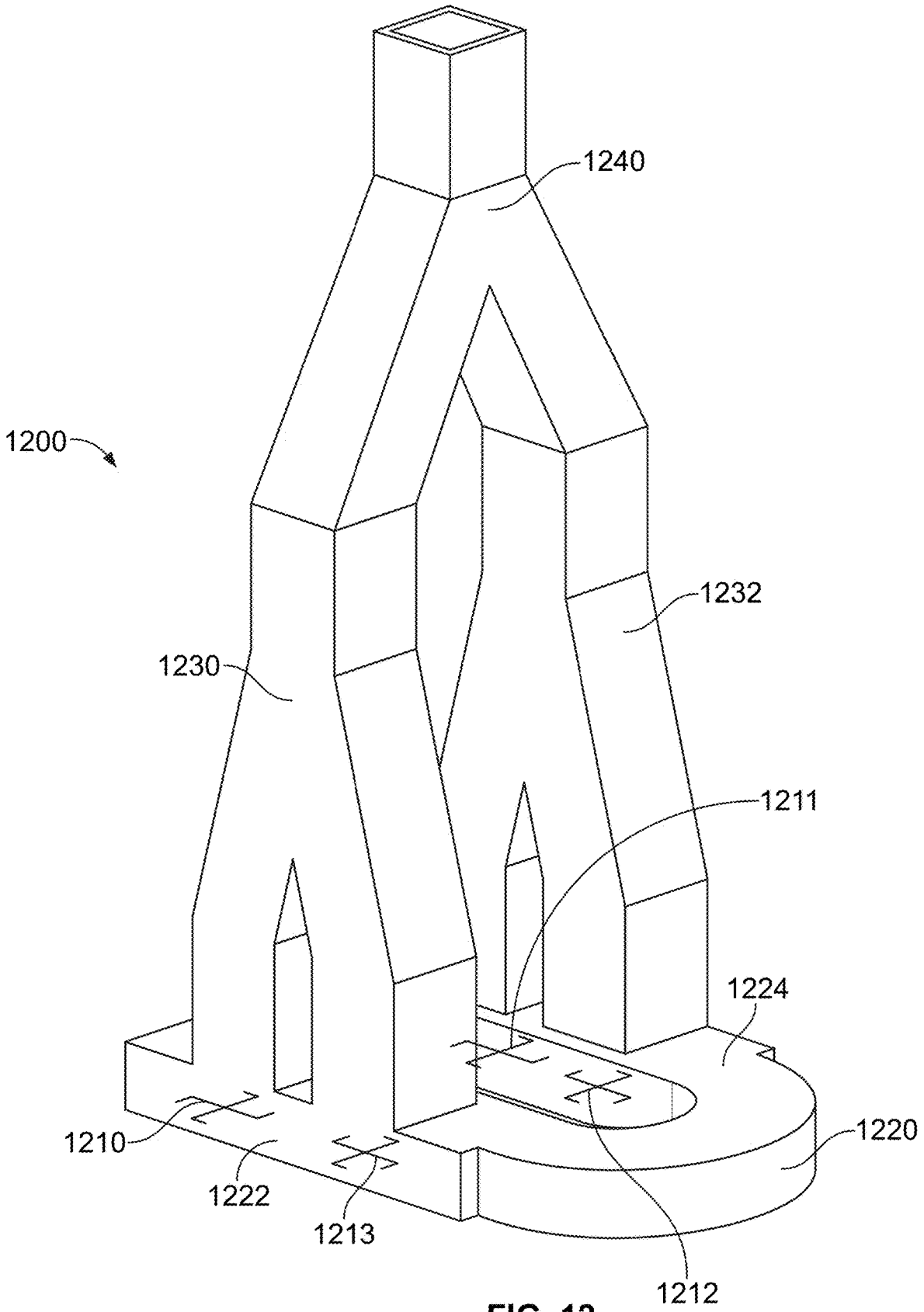
FIG. 12 is a schematic of a four-slot polarizer application for an embodiment of the present invention.

In yet another embodiment as shown in FIG. 12, polarizer 1200 includes four slots 1210-1213. This embodiment may provide 2 bands of operation with a 2% bandwidth of operation, or 4 different bands with 1.2-1.5% bandwidths of operation.

The four slots polarizer 900 uses U-shaped rectangular waveguide 1220. Two slots are on each U-arm 1222 and 1224. Each pair of slots uses the same scheme of channel combiners as the multiple slot embodiments described above. The outputs of each channel combiner 1230 and 1232 are then combined using another channel combiner 1240 as shown in FIG. 12.

The separation between U-arms 1222 and 1224 and the separation between the slots of the same arm along with the lengths of each titled channel waveguides are essential in order to avoid standing waves in the different channel sections.

While the foregoing written description enables one of ordinary skill to make and use what is considered presently to be the best mode thereof, those of ordinary skill will understand and appreciate the existence of variations, combinations, and equivalents of the specific embodiment, method, and examples herein. The disclosure should therefore not be limited by the above-described embodiments, methods, and examples, but by all embodiments and methods within the scope and spirit of the disclosure.

What is claimed is:

1. A polarizer comprising:

an antenna connected to a waveguide;

said waveguide including a broad wall;

said broad wall including a cross slot and at least one port;

said at least one port in communication with said cross slot;

further including a waveguide extraction section disposed between said waveguide and said antenna, said cross slot lot is situated at the center of said extracting waveguide section and radiates power as a circular polarization.

2. The polarizer of claim 1 wherein said waveguide is a tapered circular waveguide.

3. The polarizer of claim 1 wherein said waveguide includes a narrow wall opposing the cross slot, said narrow wall has at least one ridge.

4. A polarizer comprising:

an antenna connected to a power combiner;

said power combiner comprising:

an output waveguide connected to a first input waveguide and a second input waveguide;

a first cross slot in communication with said first input waveguide;

a second cross slot in communication with said second input waveguide.

5. The polarizer of claim 4 wherein said first cross slots has a different configuration than said second cross slot.

6. The polarizer of claim 4 further including a second power combiner; said second power combiner comprising:

a third output waveguide connected to a third input waveguide and a fourth input waveguide;

a third cross slot in communication with said third input waveguide;

a fourth cross slot in communication with said fourth input waveguide.

7. The polarizer of claim 6 further including a U-shaped rectangular waveguide with two cross slots on each U-arm.

8. The polarizer of claim 7 further including a third power combiner connected to said first power combiner and to said second power combiner.

9. The polarizer of claim 6 wherein said cross slots have different dimensions.

10. The polarizer of claim 4 wherein said first cross slot and said first input waveguide operate at a first frequency band; said second cross slot and said second input waveguide operate at a second frequency band; and said first frequency band is different than said second frequency band.

* * * * *